US005110027A

United States Patent [19]

Burlingame

[11] Patent Number: 5,110,027

[45] Date of Patent: May 5, 1992

[54] ATTACHMENT FOR HAND-HELD NAIL GUN

[76] Inventor: Allen C. Burlingame, 7622 Fountain Ave., #5, West Hollywood, Calif. 90046

[21] Appl. No.: 607,300

[22] Filed: Oct. 30, 1990

[51] Int. Cl.[5] ..... B27F 7/02

[52] U.S. Cl. ..... 227/8; 227/110

[58] Field of Search ..... 227/111, 6, 5, 8

[56] References Cited

U.S. PATENT DOCUMENTS

| | | | |
|---|---|---|---|
| 2,915,754 | 12/1959 | Wandel | 227/111 |
| 3,796,465 | 3/1974 | Downing | 227/111 |
| 3,822,817 | 7/1974 | Umphress | 227/110 |
| 3,984,040 | 10/1976 | Fry | 227/111 |
| 4,225,074 | 9/1980 | Jacobson | 227/111 |
| 4,410,050 | 10/1983 | Councell, Jr. et al. | 227/111 |
| 4,516,714 | 5/1985 | Braun et al. | 227/111 |
| 4,523,706 | 6/1985 | Haley | 227/110 |

*Primary Examiner*—Frank T. Yost
*Assistant Examiner*—Scott A. Smith
*Attorney, Agent, or Firm*—Allan M. Shapiro

[57] ABSTRACT

The attachment is a device to which a nail gun is secured. The attachment has a wheel for support of both the nail gun and attachment. The wheel is connected through appropriate gearing to actuate the safety slide on the nail gun so that, when a predetermined distance is traversed, the nail gun is actuated. The gearing is adjustable to permit preselection of the distance interval between nail gun actuation.

5 Claims, 2 Drawing Sheets

FIG. 2
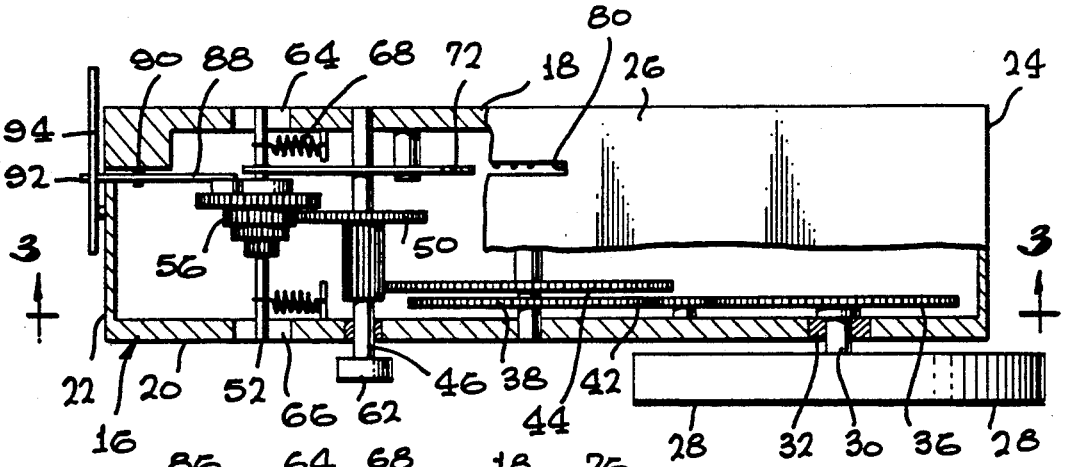
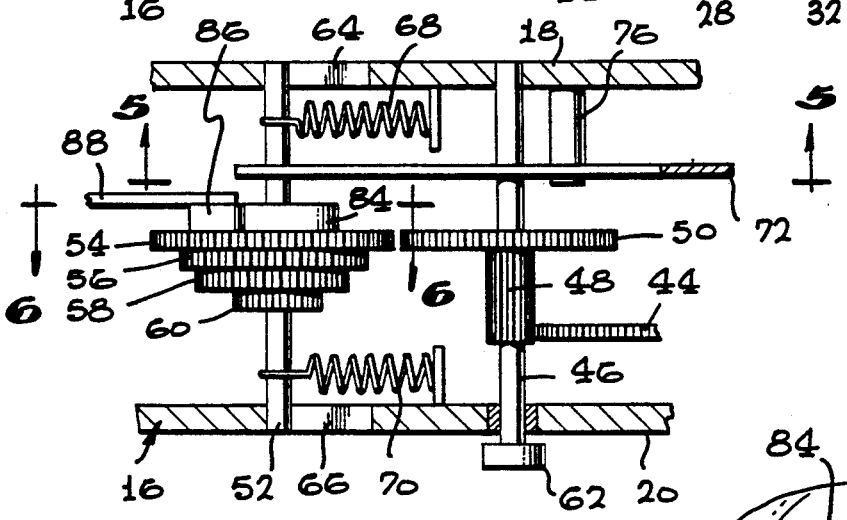
FIG. 4
FIG. 5
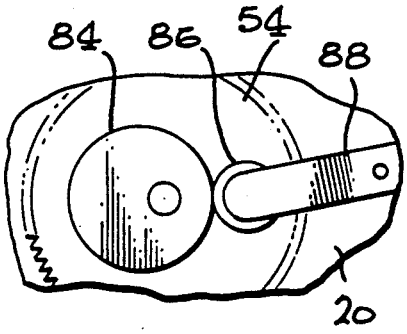
FIG. 6
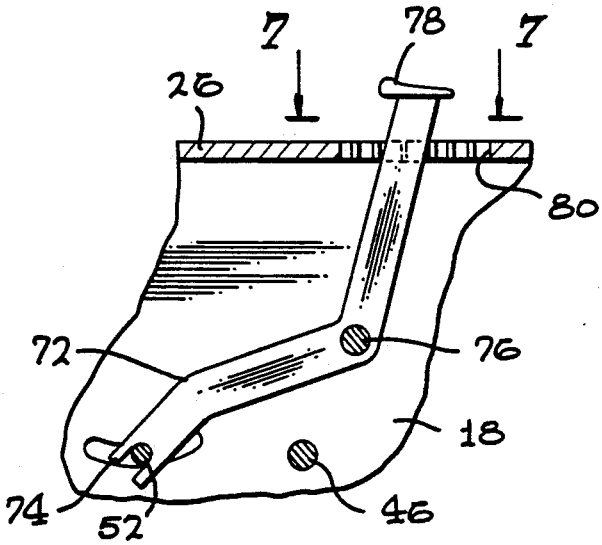
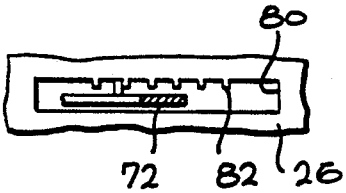
FIG. 7

ATTACHMENT FOR HAND-HELD NAIL GUN

FIELD OF THE INVENTION

This invention is directed to an attachment device to which a nail gun is secured. The device supports a nail gun, measures the distance over which the nail gun is moved, and actuates the nail gun at a preselected distance.

BACKGROUND OF THE INVENTION

Hand-held nail guns are well known in the art. They are usually pneumatically operated and are sufficiently light to be portable around a construction site where nailing is required. Such nail guns are primarily a holder for a series of nails and a pneumatic cylinder to drive the first of the nails. A trigger controls the pneumatic cylinder. In order to prevent discharge of a nail when it is not pressed against a surface, a safety slide on the front of the gun must be actuated for gun operation. The great flexibility of such guns permits them to be used in a wide variety of construction situations where such nailing is required.

While such nail guns are suitable for the attachment of roof sheathing to roof rafters, due to the fact that the surface is relatively large and many nails must be driven, specialized nailers have been created. These specialized roof-sheathing nailers have support wheels so that the nailer can be driven over the roof deck. The wheels measure the distance traversed and actuate the machine to drive nails at selected intervals. Such machines are heavy and are not suitable for other purposes.

SUMMARY OF THE INVENTION

In order to aid in the understanding of this invention, it can be stated in essentially summary form that it is directed to an attachment for a hand-held nail gun wherein the attachment comprises a wheel, control means driven by the wheel with the control means connected to the safety slide on a nail gun so that, when a predetermined distance is traversed by the attachment as measured by the wheel, the safety slide is actuated so as to fire the attached nail gun. The control means is selectable to actuate the safety slide at selectable predetermined distances.

It is, thus, an object and advantage of this invention to provide an attachment for a hand-held nail gun whereby the nail gun can be independently employed for nailing purposes and can be secured to the attachment so that the nail gun can drive nails at selected distances over the surface over which the nail gun attachment is moved.

It is another object and advantage of this invention to provide an attachment for a nail gun wherein an independently operable nail gun can be secured to the attachment and detached therefrom for independent use, and, while secured to the attachment, can fire nails at a predetermined distance as controlled by the attachment.

It is another object and advantage of this invention to provide an attachment for hand-held nail guns wherein the attachment has a wheel thereon and selective drive means between the wheel and a nail gun safety slide actuator so that the control means can be selected to actuate the safety slide at predetermined distances traversed by the wheel.

The features of the present invention which are believed to be novel are set forth with particularity in the appended claims. The present invention, both as to its organization and manner of operation, together with further objects and advantages thereof, may be best understood by reference to the following description, taken in conjunction with the accompanying drawings.

BRIEF DESCRIPTION OF THE DRAWINGS

FIG. 2 is a plan view thereof, with parts of the cover broken away to show a portion of the interior parts and showing a section through a portion of the housing.

FIG. 4 is an enlarged plan view of a portion of the internal control mechanism, showing how various preselected distances are obtained.

FIG. 5 is a side-elevational view of the control lever which selects the predetermined distance, as seen generally along line 5—5 of FIG. 4.

FIG. 6 is an enlarged side-elevational view of the actuator cam, as seen generally along line 6—6 of FIG. 4.

FIG. 7 is a plan view of the control lever of FIG. 5.

DESCRIPTION OF THE PREFERRED EMBODIMENT

Figure 1:
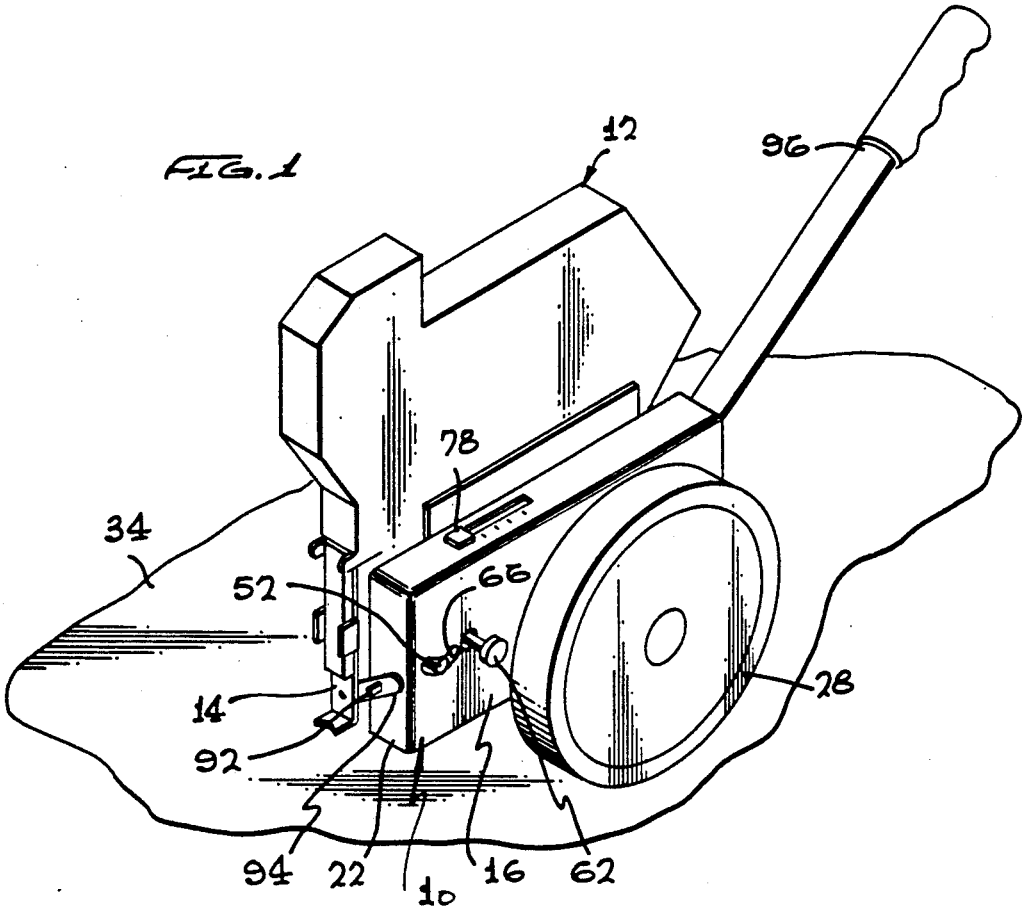
FIG. 1 is an isometric view of the attachment for hand-held nail guns in accordance with this invention, shown with a hand-held nail gun attached thereto.

The attachment of this invention is generally indicated at 10 in FIG. 1. The attachment 10 is a device for attachment to a hand-held nail gun for permitting the nail gun to be easily used for repetitive nailing over substantially flat surfaces, such as roof decks. Nail gun 12, seen in FIG. 1, is an example of a nail gun for which the attachment device 10 is useful. Nail gun 12 has a cartridge or other supply of nails or staples. It has a driver therein, such as a pneumatic cylinder, for driving a nail positioned by the cartridge. Nail gun 12 has a trigger which is usually manually operated to permit the operator to signal the gun to drive the nail.

In addition, nail gun 12 has a safety slide 14 positioned adjacent the front of the nail gun, directly adjacent the nail-driving position. The slide 14 is spring-loaded in the downward direction in FIG. 1. Safety slide 14 is connected into the control system within the nail gun in such a manner that the safety slide 14 must be raised, with the trigger in the actuated position, in order for the cylinder to be powered to drive the nail. The safety slide 14 prevents the firing of a nail except when the nose of the nail gun at which the nail is ejected is close to the work surface. The control system is such that the safety slide must be actuated each time the nail is to be fired. In order to forestall bypassing the safety feature of this slide, the safety slide 14 must move out and in again before the next nail can be fired. The nail gun 12 is, thus, a portable device which can be manually carried around the workplace and employed to drive nails as required by the operator.

Nail gun 12 is readily attachable and detachable from attachment device 10. Attachment 10 permits the nail gun to be employed as an automatic roof deck nailer or nailer for other generally flat surfaces. Attachment 10 has a housing 16 which serves as the body of the attachment. The housing 16 has an attachment wall 18 which is configured to receive thereagainst and attach thereto the nail gun 12. Attachment wall 18 may have various surface contours to fit different nail guns or may have selective adaptor plates for lying thereagainst to serve as interfaces for different configurations of nail gun. Housing 16 also has outside wall 20. The housing has connections between the two walls to hold them in spaced relationship. Front and back walls 22 and 24, together with top wall 26, achieve this structural result as well as enclose the mechanism within the housing to protect it from damage and dirt. A bottom wall may also be provided if desirable.

Wheel 28 is fixed to axle 30, which, in turn, is rotatably mounted in bearing 32 in the outside wall of housing 16, see FIG. 2. The axle is positioned toward the rear of the housing. The diameter of the wheel and the position of the axle on the housing is such that the wheel extends below the bottom of the housing, see FIG. 3. The wheel is for engagement with a surface such as roof deck surface 34, with the housing spaced slightly above the surface 34.

Gear 36 is fixed to shaft 30 so that it rotates with the wheel. Gear 38 is fixed to idler shaft 40 and is driven from gear 36 by any convenient means, such as a chain or idler gear 42. Drive gear 44 is fixed to idler shaft 40 with gear 38 so that it rotates therewith.

Counter-shaft 46 is rotatable in its bearings in the walls of the housing and is also axially slidable, as indicated in FIG. 4. Counter-shaft 46 carries long pinion 48 thereon, which is in engagement with drive gear 44, and also carries pickoff gear 50 thereon fixed to the pinion. Thus, pickoff gear 50 rotates with rotation of wheel 28, and its rotation is proportional thereto. The drive mechanism described above between the wheel and the pickoff gear is a preferred embodiment of such a drive mechanism, but is just an example of the manner in which the pickoff gear 50 is driven in a way that is directly proportional to the rotation of the wheel 28. Of course, the rotation of the wheel 28 is a direct function of the amount of travel the attachment makes across the surface on which the wheel is engaged. Thus, the rotation of pickoff gear 50 is a direct function of the distance the attachment is moved.

Different construction tasks require spacing between the nails driven by the nail gun and, since the rotation of pickoff gear 50 is directly proportional to the distance, the pickoff gear 50 cannot be directly used to actuate the nail gun.

Figure 3:
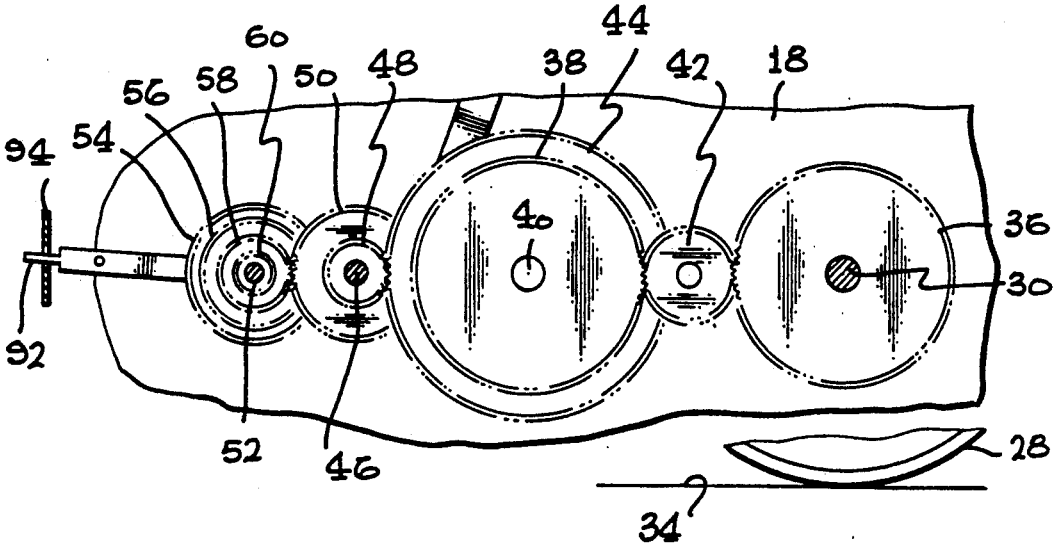
FIG. 3 is a side-elevational view of the portion of the internal structure, as seen generally along the line 3—3 of FIG. 2.

Cluster gear shaft 52 has a plurality of cluster gears thereon, each of a different size and each suitable for selective mating with the pickoff gear 50. Four cluster gears 54, 56, 58 and 60 are shown to provide selection of four different nail spacings. More or fewer cluster gears may be employed, depending on the number of spacing selections desired. As previously described, counter-shaft 46 is axially movable so as to axially position its pickoff gear 50. In the position shown in FIG. 4, counter-shaft 46 and pickoff gear 50 are axially positioned so that pickoff gear 50 is in engagement with cluster gear 54. In FIG. 2, pickoff gear 50 is shown in engagement with cluster gear 56. In FIG. 3, pickoff gear 50 is shown in engagement with cluster gear 58. In this way, the proportionality of rotation of the cluster gears and their cluster gear shaft 52 is selected. Knob 62 permits manual positioning of the pickoff gear 50. Gear-tooth engagement is maintained between the selected cluster gear and the pickoff gear by providing for sliding of the cluster gear shaft.

Cluster gear shaft 52 engages in slots 64 and 66 and is urged in the rightward direction by springs 68 and 70. Lever 72, see FIG. 5, has a fork 74 which engages around cluster gear shaft 52. Lever 72 is pivoted on post 76 and extends upward through a slot in the top wall 26 to terminate in knob 78. The slot is seen in FIG. 7 and is identified as slot 80. Manual engagement of knob 78 moves the cluster gear shaft 52 to the left so that pickoff gear 50 can be moved to the selected position. Stop 82 in slot 80 can be employed to hold the cluster gears in the disengaged position while the pickoff gear is moved to the selected position. The distance the lever 72 moves when it is released depends upon which cluster gear the pickoff gear 50 engages. Thus, the position of the knob 78, when released, signals which cluster gear is engaged. Indicia are shown with respect to the knob 78 in FIG. 1 to show the user the gear ratio attained.

Cam 84 is fixed on cluster gear shaft 52. Cam follower 86 engages the cam and is mounted on lever 88. Lever 88 is pivoted on pin 90, see FIG. 2, and extends out of the housing at nose 92. As seen in FIG. 2, the nose 92 moves up and down. Nose 92 engages in lever 94 to move the lever 94 up and down. Lever 94, in turn, is directly connected to safety slide 14 so that, when nose 92 moves up, the safety slide 14 moves up. This apparatus, thus, raises the safety slide at selected distances traversed by the attachment. As described above, the nail gun 12 is arranged so that, when the trigger thereon is continuously depressed, successive raising of the safety slide causes successive actuation of the nail gun. Thus, nails are driven at spaced intervals as the attachment and its nail gun are moved across the deck surface. The spacing is selected by engaging the corresponding cluster gear. This structure is sufficiently simple and light that it can be operated on vertical surfaces, such as for nailing on plywood wall sheathing or wall covering. The nail gun 12 can be quickly detached for other use and reattached for spaced interval nailing on surfaces. Handle 96 is attached to the housing 16 to aid in manual control of the attachment with its nail gun.

This invention has been described in its presently contemplated best modes, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. An attachment for a hand-held nail gun comprising:

a housing, said housing having attachment means for attaching said housing to a hand-held nail gun having a safety slide thereon;

a slide wheel rotatably mounted on said housing, said wheel being for engagement with a surface along which the housing is moved;

a drive train within said housing, said drive train being connected to said wheel to be driven by said wheel as said attachment moves along a surface;

a connector connected to said drive train and to the safety slide on the nail gun so that said connector and the safety slide are actuated when the attachment is moved a predetermined distance along the surface, said drive train being variable so that said predetermined distance is preselectable; and said drive train including a cluster of a plurality of different sized gears and a pickoff gear which can be positioned to selectively engage one of said gears in said gear cluster so as to select the drive train ratio to select said predetermined distance the attachment moves along the surface between connector actuations.

2. The attachment of claim 1 wherein said pickoff gear is connected to an external indicator so that said indicator indicates the cluster gear engaged by said pickoff gear to thus indicate the ratio of said drive train and indicate the distance said attachment moves along the surface between connector actuations.

3. The attachment of claim 2 wherein said gear cluster drives a cam and there is a cam follower in engagement with said cam, said cam follower being connected to said connector for actuation thereof.

4. The attachment of claim 2 wherein there is a manually engageable handle connected to said housing so that said housing can be moved along a surface with said wheel in engagement with the surface.

5. The attachment of claim 1 wherein said gear cluster drives a cam and there is a cam follower in engagement with said cam, said cam follower being connected to said connector for actuation thereof.

* * * * *